US008115088B2

(12) United States Patent
Herrera

(10) Patent No.: US 8,115,088 B2
(45) Date of Patent: Feb. 14, 2012

(54) CAJON INSTRUMENT

(76) Inventor: Cris Herrera, Gilroy, CA (US)

( * ) Notice: Subject to any disclaimer, the term of this patent is extended or adjusted under 35 U.S.C. 154(b) by 68 days.

(21) Appl. No.: 12/793,936

(22) Filed: Jun. 4, 2010

(65) Prior Publication Data

US 2011/0296973 A1 Dec. 8, 2011

(51) Int. Cl.
*G10D 13/02* (2006.01)

(52) U.S. Cl. ..... 84/411 R

(58) Field of Classification Search ..... 84/411 R
See application file for complete search history.

(56) References Cited

U.S. PATENT DOCUMENTS

| | | | | | |
|---|---|---|---|---|---|
| 362,099 | A | * | 5/1887 | Maloney | 181/136 |
| 1,980,876 | A | * | 11/1934 | Peters | 84/411 R |
| D100,734 | S | * | 8/1936 | Liras | D17/22 |
| 2,858,724 | A | * | 11/1958 | Troppe | 84/411 R |
| 3,603,194 | A | * | 9/1971 | North | 84/411 R |
| 3,621,749 | A | * | 11/1971 | Aluisi | 84/411 R |
| D242,874 | S | * | 12/1976 | Clements et al. | D17/22 |
| D242,876 | S | * | 12/1976 | Clements et al. | D17/22 |
| 4,026,185 | A | * | 5/1977 | Migirian | 84/411 R |
| 4,102,236 | A | * | 7/1978 | North | 84/411 R |
| 4,134,324 | A | * | 1/1979 | LeMert | 84/411 R |
| 4,173,917 | A | * | 11/1979 | Della-Porta | 84/419 |
| 4,184,407 | A | * | 1/1980 | Townshend | 84/411 R |
| D258,134 | S | * | 2/1981 | Widener | D17/22 |
| D267,014 | S | * | 11/1982 | Migirian | D17/22 |
| 4,373,419 | A | * | 2/1983 | Tuttrup | 84/411 R |
| D288,696 | S | * | 3/1987 | Hoshino | D17/22 |
| 4,731,141 | A | * | 3/1988 | Thirion | 156/171 |
| D296,447 | S | * | 6/1988 | Jowitt | D17/22 |
| 4,805,514 | A | * | 2/1989 | Billings | 84/411 M |
| 5,385,075 | A | * | 1/1995 | Carnes et al. | 84/411 R |
| D395,444 | S | * | 6/1998 | Agu | D17/22 |
| D571,851 | S | * | 6/2008 | Myers | D17/22 |
| 7,482,522 | B2 | * | 1/2009 | Wening | 84/415 |
| 7,485,790 | B2 | * | 2/2009 | Payerl | 84/411 R |
| 7,601,901 | B2 | * | 10/2009 | Payerl | 84/411 R |
| 7,659,469 | B2 | * | 2/2010 | Belli | 84/411 R |
| 7,692,083 | B2 | * | 4/2010 | Aspland | 84/415 |
| 7,799,981 | B1 | * | 9/2010 | Curet Troche | 84/411 R |
| 7,816,596 | B2 | * | 10/2010 | Bottger | 84/411 R |
| 7,932,452 | B2 | * | 4/2011 | Chen | 84/411 R |
| 7,968,780 | B2 | * | 6/2011 | Millender et al. | 84/411 R |
| 8,008,560 | B2 | * | 8/2011 | Wiese et al. | 84/411 R |

FOREIGN PATENT DOCUMENTS

DE 202007000686 * 6/2007

* cited by examiner

*Primary Examiner* — Elvin G Enad
*Assistant Examiner* — Robert W Horn
(74) *Attorney, Agent, or Firm* — Central Coast Patent Agency, Inc.

(57) ABSTRACT

A cajon percussion instrument has an open rectangular box structure joined to a striking plate on one side, and to a truncated pyramid structure on the other side, providing a focusing resonating chamber with a rectangular mouth for sound emission.

4 Claims, 3 Drawing Sheets

CAJON INSTRUMENT

BACKGROUND OF THE INVENTION

1. Field of the Invention

The present invention relates to musical percussion instruments, and more particularly to a cajon.

2. Description of Related Art

The musical percussion instrument known as the cajon, is well established in prior art. Being utilized in many musical art forms and various ethnic cultures across the globe, its popularity among percussion musicians is becoming increasingly widespread.

The cajon is most commonly played by sitting astride the cuboid wooden structure and striking a playing surface or head, generally made from a thinner material of greater tympanic qualities, with open hands onto one surface of the instrument. The result being a sound wave that reverberates throughout the sound chamber of the cubic form and exits, most commonly, through a circular hole located on an opposing surface of the cube. Therefore, by percussions provided by a musician to the striking surface, a distinct tonal quality, which is unique to this particular style of instrument, is provided.

Various apparatus forms have been added over time to the basic cajon to modify the intonation of the instrument, such as may be found in the various wire or rod curtains that may afford a snare-drum effect, or other damping, baffles or reed apparatus of prior art, for a few examples. Other modifications have been made to the sound exit hole or mouth of the sound chamber, by way of inserted or integrated tubular forms, in an attempt to increase or focus the sound volume.

The inventor of the present disclosure has identified several shortcomings in the intonation quality and the acoustics for cajon drums, along with various attempts to increase their acoustical volume, that have been manifested in prior art or commercially available. Thus, it has occurred to the inventor, improvements to the acoustics of the sound may be afforded with various modifications to the shape of the sound chamber and subsequently to the exit mouth of this chamber, which are further described in embodiments taught in this disclosure. The disclosed features may significantly increase the volume of sound and enhance the tonal or voice quality of the cajon, comparatively to those which are commercially available, or may be found in prior art.

BRIEF SUMMARY OF THE INVENTION

In an embodiment of the present invention a cajon percussion instrument is provided comprising an open rectangular box structure formed of four planar structural panels rigidly joined along two edges of each panel at substantially right angles, leaving first and second opposite rectangular edge interfaces formed by edges of the box structure, the box structure providing a seat for a player person, a tapa strike plate securely joined to the first rectangular edge interface of the box structure, providing a percussion input for the player person to strike, and a hollow truncated pyramid structure formed with four panels, having a major base of the rectangular shape and dimension of the second rectangular edge interface, and an open opposite minor base, the major base joined rigidly to the second rectangular edge interface of the box structure. Sound produced in the box structure by percussion input from the striking plate is conducted through the pyramid structure and emitted from the open minor base of the truncated pyramid structure.

In one embodiment the tapa striking plate is joined to the box structure by fasteners with spacers between the striking plate and the box structure, leaving the top two corners of the striking plate free, such that the player person may strike the striking plate corners against the box structure. In another embodiment there are foot pads on the bottom panel of the box structure, raising the instrument off a supporting surface. Also in one embodiment the striking plate is formed from clear polycarbonate material.

DETAILED DESCRIPTION OF THE INVENTION

Figure 1:
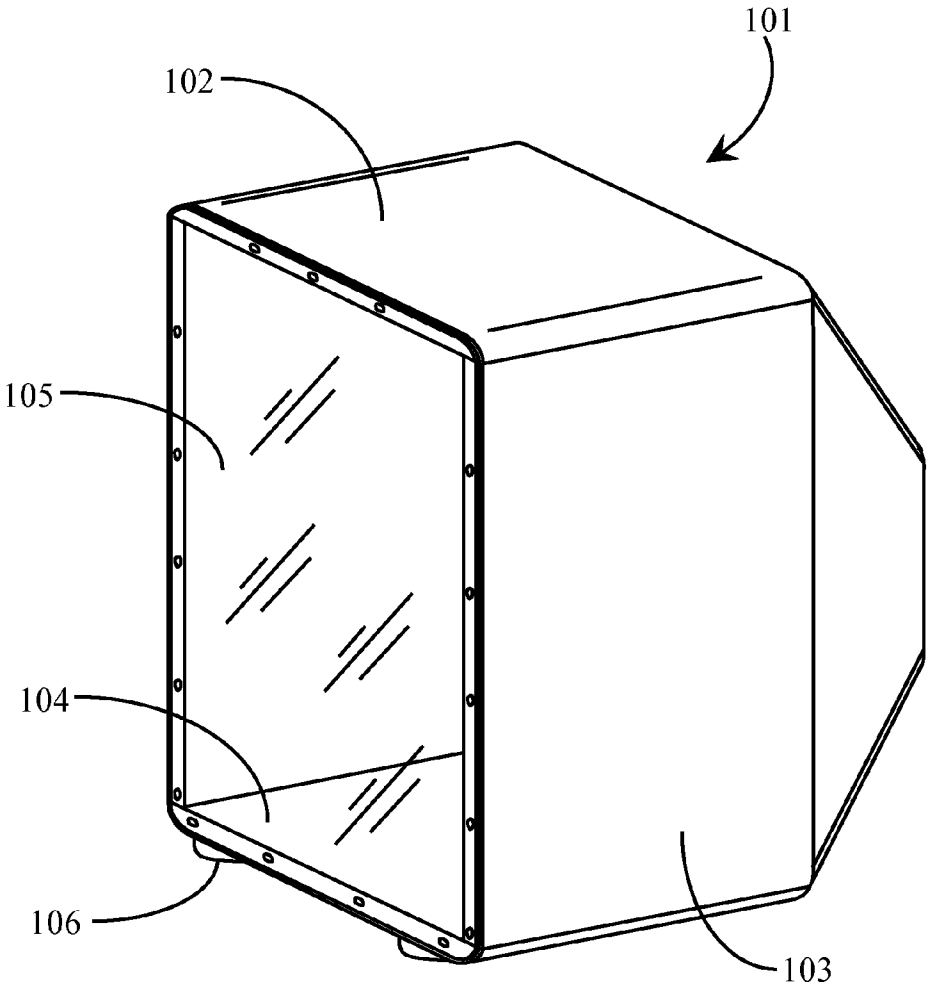
FIG. 1 is an isometric view a cajon according to one embodiment of the present invention.

FIG. 1 is an isometric view of a cajon 101 according to one embodiment of the present invention. The cajon in this embodiment comprises several panels, most generally of thick wood, which form a four-sided rectangular cube structure, wherein a musician may sit astride a top panel 102. Side panels 103 and a bottom panel element 104 complete the rectangular box structure and form the primary support for the musician during the playing of the instrument, in a manner much like sitting on a small box-like stool. A straddling position is assumed over the box-like structure with the musician facing forward in the direction of a striking plate 105, often referred to as the tapa, with open hands between open knees, one on each side of the instrument with feet resting on the floor. This position, being the most common for percussion musicians that play this style of instrument, is generally agreed upon by most percussionists to be the position that affords the best vantage point to strike the head surface.

The striking plate 105 is commonly made from a thinner panel of wood, either solid or laminate hardwood, or luan for example. The inventor recommends a thin panel of clear polycarbonate plastic (Lexan), which affords the cajon a unique voice, according to one embodiment of the present invention. The striking plate may also be made from a number of other materials, but should be limited to selections that may provide the best tendency for good tympanic qualities.

The striking plate is attached to the rectangular box-like structure using fasteners appropriately spaced to provide a solid attachment to the edge faces of the structure panels. In some cases the striking plate may be mounted with spacers between the striking plate and the box panel edges, allowing the striking plate to be spaced apart by a small dimension from the box panel edges, with the upper corner edges left unattached, such that they may be slapped against the edge faces of the box-like structure to provide certain drum tones, according to the preferences of the percussionist.

Figure 2:
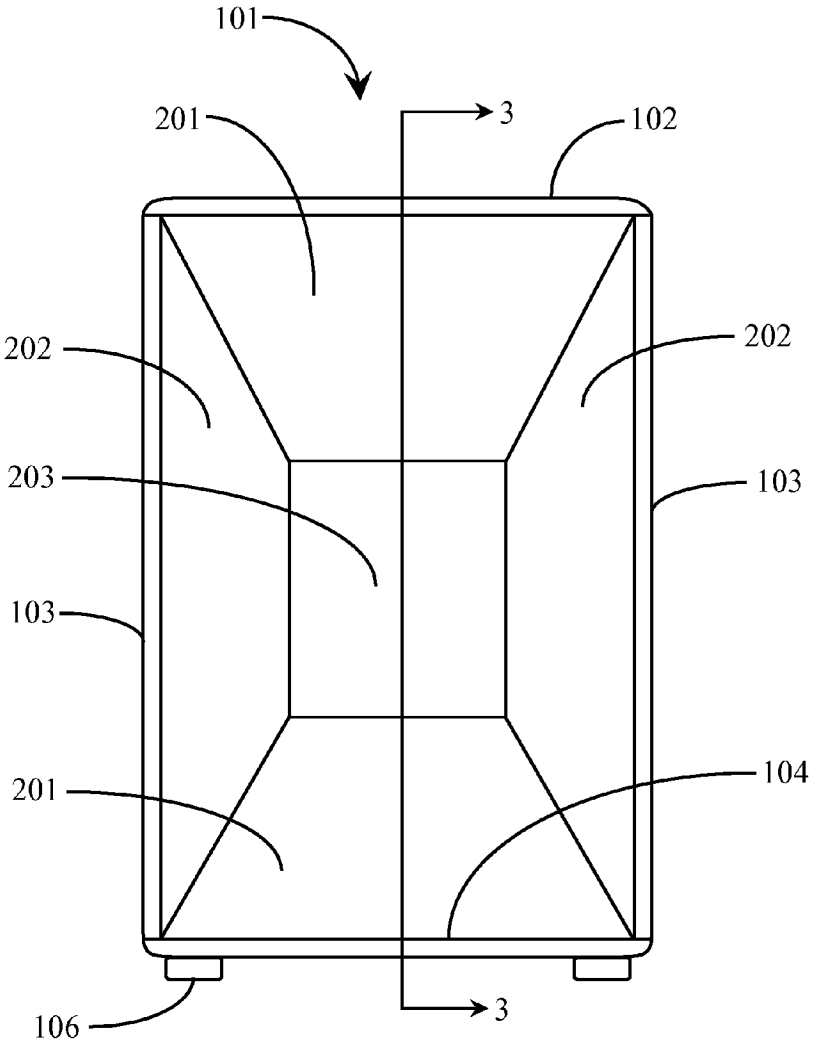
FIG. 2 is a front view of the cajon of FIG. 1 according to one embodiment of the present invention, with a striking plate 105 removed for clarity.
Figure 3:
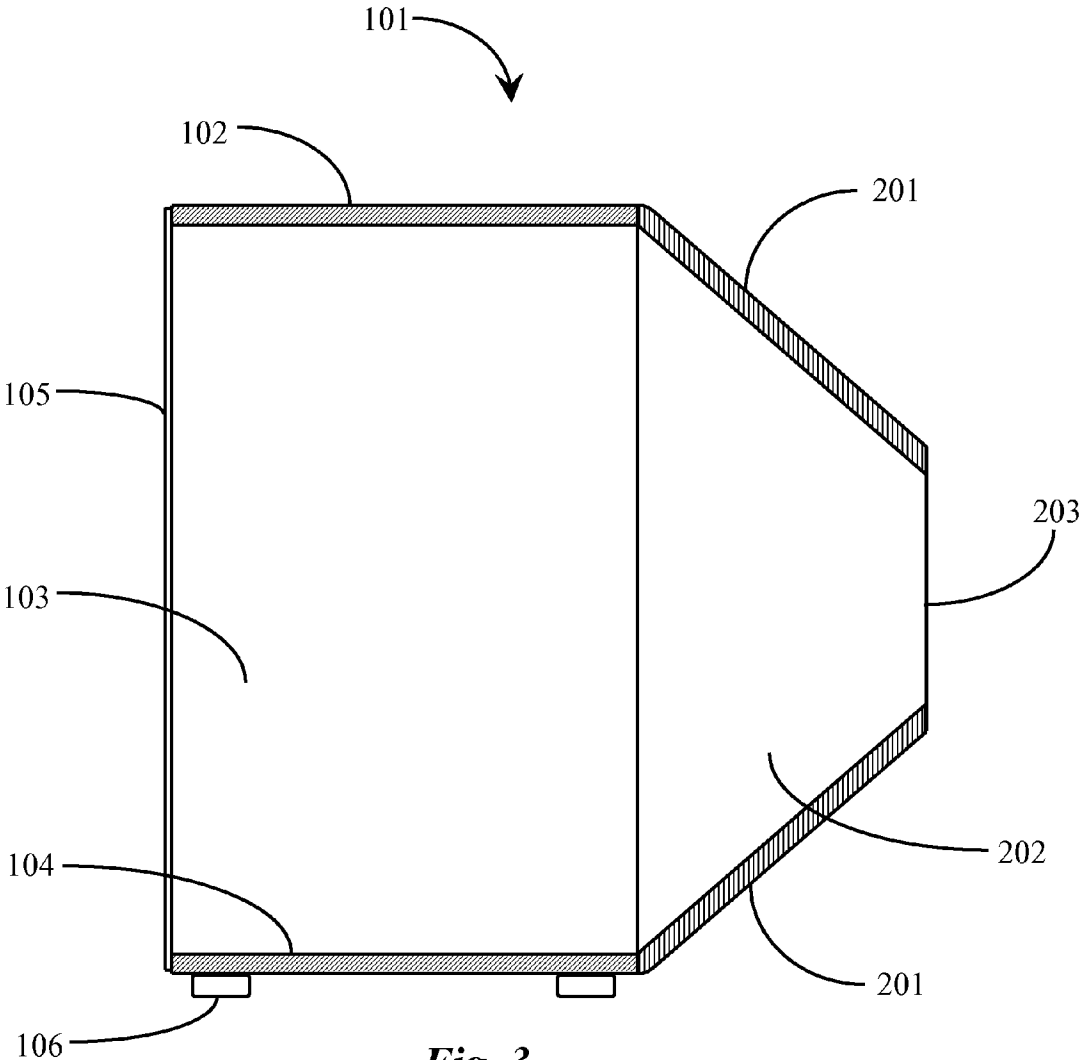
FIG. 3 is a cross-sectioned view of the cajon of FIG. 2 according to one embodiment of the present invention.

The cajon of FIG. 1 may also comprise several panels, elements 201 and 202 (FIG. 2), which extend at acute angles to the primary box-like structure which the percussionist sits astride. These panels, being joined into a double open-ended four-sided truncated pyramid, extend beyond the base structure on the opposite side to which the strike plate is attached, as may be seen in FIG. 2 and FIG. 3, according to one embodiment of the present invention. The pyramid form may be attached to the box-like structure by means of glue or fasteners, or a combination thereof. The pyramid shape, together with the panels that form the base, comprise a primary sound chamber, which resonate the sound developed from contact with the striking plate 105 of the instrument.

The cajon of FIG. 1 may also comprise a group of foot pads 106 that raise the completed sound chamber from the floor, which may afford an unhampered reverberation and clearer tone quality to the instrument. It should be noted that small footprints translated to the floor and the use of hard materials provide less opportunities for dampening the sound chambers resonations than larger footprints and softer materials provide.

A rectangular orifice, opposing and centrally located to the striking plate, forms a mouth 203 in which the voice of the instrument may exit and be heard. The rectangular mouth provides a greater area for sound to escape from the sound chamber, thereby generating a marked increase in the overall volume of sound, which may be afforded by the common circular orifices of the cajon, which may be found commercially today. Another marked difference afforded with the cajon of FIG. 1 is the shape and functionality of the pyramid-like throat for the mouth of the instrument, which aids in focusing the sound reverberations, through this orifice more efficiently, according to one embodiment of the present invention.

It should also be noted, that the cajon of FIG. 1 may easily accommodate internal and external appendages and apparatus such as snare curtains, foot pedals, reed or rod arrangements for a few examples, which are used to vary the intonation or voices that are common to this type of instrument.

It will be apparent to a skilled artisan that the embodiments described above are exemplary of inventions that may have greater scope than any of the singular descriptions. There may be many alterations made in these examples without departing from the spirit and scope of the invention. For example, the size, shape and material configuration may vary widely. The shape, size and location of the mouth and throat of the sound chamber may also vary widely. These and many other features may change in different embodiments.

The invention claimed is:

1. A cajon percussion instrument, comprising:

an open rectangular box structure formed of four planar structural panels rigidly joined along two edges of each panel at substantially right angles, leaving first and second opposite rectangular edge interfaces formed by edges of the box structure, the box structure providing a seat for a player person;

a tapa strike plate securely joined to the first rectangular edge interface of the box structure, providing a percussion input for the player person to strike; and a hollow truncated pyramid structure formed with four panels, having a major base of the rectangular shape and dimension of the second rectangular edge interface, and an open opposite minor base, the major base joined rigidly to the second rectangular edge interface of the box structure;

wherein sound produced in the box structure by percussion input from the striking plate is conducted through the pyramid structure and emitted from the open minor base of the truncated pyramid structure.

2. The cajon percussion instrument of claim 1 wherein the tapa striking plate is joined to the box structure by fasteners with spacers between the striking plate and the box structure, leaving the top two corners of the striking plate free, such that the player person may strike the striking plate corners against the box structure.

3. The cajon percussion instrument of claim 1 further comprising foot pads on the bottom panel of the box structure, raising the instrument off a supporting surface.

4. The cajon percussion instrument of claim 1 further wherein the striking plate is formed from clear polycarbonate material.

* * * * *